US009051029B2

(12) United States Patent
Hays, III

(10) Patent No.: US 9,051,029 B2
(45) Date of Patent: Jun. 9, 2015

(54) QUICK RELEASE PADDLE FORCE TRANSFER SEAT AND METHOD OF INSTALLATION

(71) Applicant: William W. Hays, III, Lynchburg, VA (US)

(72) Inventor: William W. Hays, III, Lynchburg, VA (US)

( * ) Notice: Subject to any disclaimer, the term of this patent is extended or adjusted under 35 U.S.C. 154(b) by 0 days.

(21) Appl. No.: 13/951,170

(22) Filed: Jul. 25, 2013

(65) Prior Publication Data

US 2014/0026806 A1 Jan. 30, 2014

Related U.S. Application Data

(60) Provisional application No. 61/741,597, filed on Jul. 25, 2012.

(51) Int. Cl.
*B63B 29/04* (2006.01)
*B63B 35/71* (2006.01)

(52) U.S. Cl.
CPC ..... *B63B 29/04* (2013.01); *Y10T 29/49826* (2015.01); *B63B 35/71* (2013.01); *B63B 2029/043* (2013.01)

(58) Field of Classification Search
CPC ..... B63B 35/71
USPC ..... 114/363, 347
See application file for complete search history.

(56) References Cited

U.S. PATENT DOCUMENTS

| | | | | | |
|---|---|---|---|---|---|
| 4,942,840 | A * | 7/1990 | Masters et al. | 114/363 |
| 5,168,825 | A * | 12/1992 | Ring | 114/363 |
| 5,189,974 | A * | 3/1993 | Masters | 114/61.15 |
| 5,257,590 | A * | 11/1993 | Foote et al. | 114/347 |
| 5,417,179 | A * | 5/1995 | Niemier et al. | 114/347 |
| 6,644,233 | B2 * | 11/2003 | Batt et al. | 114/347 |
| 2014/0026806 | A1 * | 1/2014 | Hays, III | 114/363 |

* cited by examiner

*Primary Examiner* — Lars A Olson
*Assistant Examiner* — Jovon Hayes
(74) *Attorney, Agent, or Firm* — Daniel Boudwin; Global Intellectual Property Agency LLC

(57) ABSTRACT

A paddle force transfer assembly is provided that is adapted to be installed about an existing canoe bench seat. The assembly secures the thighs of a canoe occupant while providing a foot brace under the seat, whereby the occupant can bear against the thigh braces and the foot brace when exerting force on the canoe paddle in rough water conditions. The thigh braces may be biased to rotate into a downward, open configuration when the user retracts his or her thighs therefrom, whereby the user is not restrained by the supports in a capsizing event. The assembly anchors to the interior surface of the canoe about the canoe seat and is secured thereto and around the seat using a plurality of anchors and strap connectors that transfer load from the paddle, through the user and the present assembly, and into the canoe for increased control without sacrificing emergency exit safety.

13 Claims, 12 Drawing Sheets

QUICK RELEASE PADDLE FORCE TRANSFER SEAT AND METHOD OF INSTALLATION

CROSS REFERENCE TO RELATED APPLICATION

This application claims the benefit of U.S. Provisional Application No. 61/741,597 filed on Jul. 25, 2013, entitled "Freedom Braces: Safe, no-entanglement, auto-release, canoe-seat-mounted thigh and foot braces." The above identified patent application is herein incorporated by reference in its entirety to provide continuity of disclosure.

BACKGROUND OF THE INVENTION

1. Field of the Invention

The present invention relates to canoes and improvements in paddler bracing in canoes with standard seats. More specifically, the present invention pertains to a new and novel canoe bracing assembly that assists a user's ability to transfer force into the canoe paddle from a stable position within the canoe, while also not compromising safety of the paddler by allowing for swift and efficient exiting of the canoe in an emergency event.

High maneuvering forces are required when canoeing in turbulent waters and in white-water conditions. The canoeing user is required to exert considerable force on a canoe paddle in order to maintain the boat's course and maneuver between hazards in the environment, while also preventing the boat from capsizing in very violent waters. This force exertion dictates that the canoe occupants are 'locked' into the canoe for maximum paddle force transfer and, if necessary, requires that all occupants are able to exit the canoe freely, quickly, and without restrictions or manual releases. In order to accomplish these goals, canoe braces are required that secure the occupants of a canoe in position, while also offering an efficient means of exiting the canoe without requiring manual release that can be difficult to accomplish in rough conditions or once the boat becomes capsized.

The prior art describes various seating devices for canoes and personal watercraft that lockably secure a paddler to the boat. However, these devices create a significant risk of bodily injury if the occupants are unable easily to remove themselves from the restraint. What is required is a device that does not introduce this risk and allows for quick and easy exiting of the canoe in an emergency situation. Most of the prior art devices involve thigh straps that restrict movement of the occupant and do not involve a quick release means. These straps introduce an entanglement risk and risk of serious injury or drowning if the canoe were to capsize.

Simply adding thigh straps to a standard canoe bench seat, as the prior art suggests, increases entrapment risks, as the seats prevent rearward movement needed to disengage from thigh straps. Therefore the straps must be released by hand or, that failing, cut with a knife. Either option is not likely to be successful unless conducted by the most well prepared paddler and accomplished canoe user. In order to minimize exit dangers and maximize paddle-force transfer, canoe outfitters usually remove the seats and add an open saddle seat with thigh straps and foot pegs. This saddle combination comes at a significant cost to the user and reversing the installation back to a stock seat is not practical. Canoes outfitted also lose cargo space and remain dangerous in emergency situations where a swift exit is required.

The present invention provides a ready solution to a long-standing need in the art of canoeing and watersports involving paddle-driven transport. The device comprises a new and novel bracing arrangement that is specifically designed for use with a canoe with conventional seat, wherein the integrity of the canoe is maintained and the device can be installed with minimal modification to the canoe structure. The device is designed to incorporate a standard canoe seat and provide a secure, 'locked-in' kneeling arrangement that avoids the use of harnesses or other devices that would limit exiting from the canoe in an emergency. The present invention also retains much of the canoe interior cargo space and functions when the canoe is used as a solo or tandem canoe, wherein the device can be readily purchased and installed at a much lower cost than existing saddle seat installations.

2. Description of the Prior Art

Devices have been disclosed in the prior art that relate to canoe user securement means, new canoe seats, and tethers that secure the user into existing canoe seats. These include devices that have been patented and published in patent application publications.

It is submitted that the present invention is substantially divergent in design elements from the prior art, and consequently it is clear that there is a need in the art for an improvement to paddler bracing with existing canoe seat assemblies. In this regard the instant invention substantially fulfills these needs.

SUMMARY OF THE INVENTION

In view of the foregoing disadvantages inherent in the known types of paddler bracing with canoe seat assemblies now present in the prior art, the present invention provides a new canoe user securing assembly and paddle force transfer assembly that can be utilized for providing convenience for the user when maintaining a canoeing user in a canoe during periods of rigorous paddling, while allowing the same user to freely exit the canoe if the canoe capsizes.

It is therefore an object of the present invention to provide a new and improved canoe paddle force transfer assembly that has all of the advantages of the prior art and none of the disadvantages.

It is another object of the present invention is to provide a canoe paddle force transfer assembly that can be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
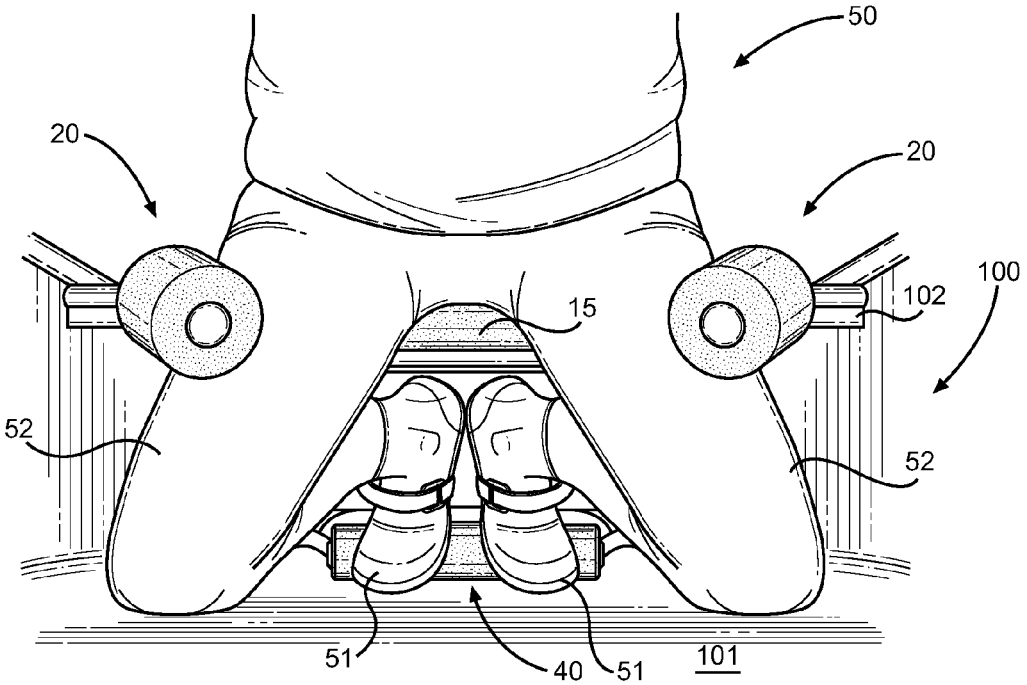
FIG. 1 shows a view of a canoe user seated within the assembly of the present invention.

Reference is made herein to the attached drawings. Like reference numerals are used throughout the drawings to depict like or similar elements of the canoe seat assembly. For the purposes of presenting a brief and clear description of the present invention, the preferred embodiment will be discussed as used for providing a means of securing the legs of a canoe occupant while also allowing the occupant to readily escape the canoe in an emergency. The figures are intended for representative purposes only and should not be considered to be limiting in any respect.

The present invention is an open, thigh-and-foot-brace assembly constructed primarily of elongated tubes having a foam covering. The assembly utilizes a standard canoe bench seat for mounting and support. This assembly effectively "locks" a canoe paddler to the canoe while allowing quick and easy emergency exits. When "locking in", the paddler kneels in front of the seat, places his buttocks on the seat edge, and deploys (rotates) the thigh braces inward. The canoe user presses his thighs forward and outward against the foam-covered braces and adjusts the foot brace to apply forward pressure to assist in maintaining firm thigh brace contact. (Alternatively, the foot brace may be adjusted to provide instep support). When in this "locked" condition, the paddler can transfer his paddling forces directly and efficiently to the boat.

For a quick, 'clean' emergency exit, the paddler simply brings his thighs together, which frees him from the braces as if the braces had not been deployed. In absence of leg pressure, an embodiment of the present invention contemplates a retractor means, which rotates the thigh braces out of the way and increases the body and cargo clearance. Proper installation places no impediments in the way of the paddler's legs or feet that would otherwise create an entanglement risk or impede the user in an emergency exit. This system can be applied to solo and tandem canoe configurations, the latter capable of being placed in any of the three seat positions of a canoe while accommodating easy tandem/solo position switching.

The present invention is derived from the desire to outfit a conventionally-seated, touring/white-water canoe with safe and effective canoe paddler "lock-in" for a kneeling user. The usual thigh straps that often entangle paddlers and create life-threatening circumstances are avoided. After user experiences with existing thigh straps with seats and their propensity to pin the user in rough waters or in roll-over events, the present invention was designed to provide the same level of connection with the canoe but without the entanglement risks.

White-water paddlers typically remove seats and install saddles, thigh straps, and foot pegs/pedals. These work very well for providing "lock-in" for white-water paddling, but they eliminate cargo space, and they force the paddler always to kneel. The present invention works with standard canoe bench seats and most tubular-framed seats, accommodating both seated and kneel-paddling. And, while kneeling, the paddler can "lock in" for the control and paddling forces associated with upper-class rapids. This is accomplished all while the original cargo space is preserved.

Unlike saddle installations, the present invention does not permanently alter the canoe structure, wherein the assembly is easily adjusted or removed. Most importantly, the present invention adds nothing that can entangle a paddler. And, since applied thigh pressure is what keeps the paddler "locked in", emergency exit is as natural and easy as relaxing and falling out.

Retaining the canoe's functional seats is a driving requirement behind the present invention. Optimum function, safety, and comfortable paddling position are also top-level requirements. Raising the seats upwards to just under the gunwale supports is best for these last three requirements: 1) direct gunwale attachment for firm, lateral transfer of paddle forces for boat control, 2) a safe foot clearance under the seat, and 3) less knee flex for more comfort in kneeling (especially for older, stiffer paddlers like the designer). Removing any seat height spacers and remounting the seats directly to the gunwale supports before installing the present invention is highly recommended for all the above reasons. When kneeling with one's feet under a seat that is positioned at your intended height, it is required that there be adequate clearance for the user's feet and no restrictions. Any restrictions on the user's feet will defeat the purpose of the present invention and possibly snare the user trying to exit in an emergency.

Referring now to FIGS. 1 through 17, there are shown several views of the present invention and its embodiments, along with the installation of the present invention onto an existing canoe seat.

Figure 2:
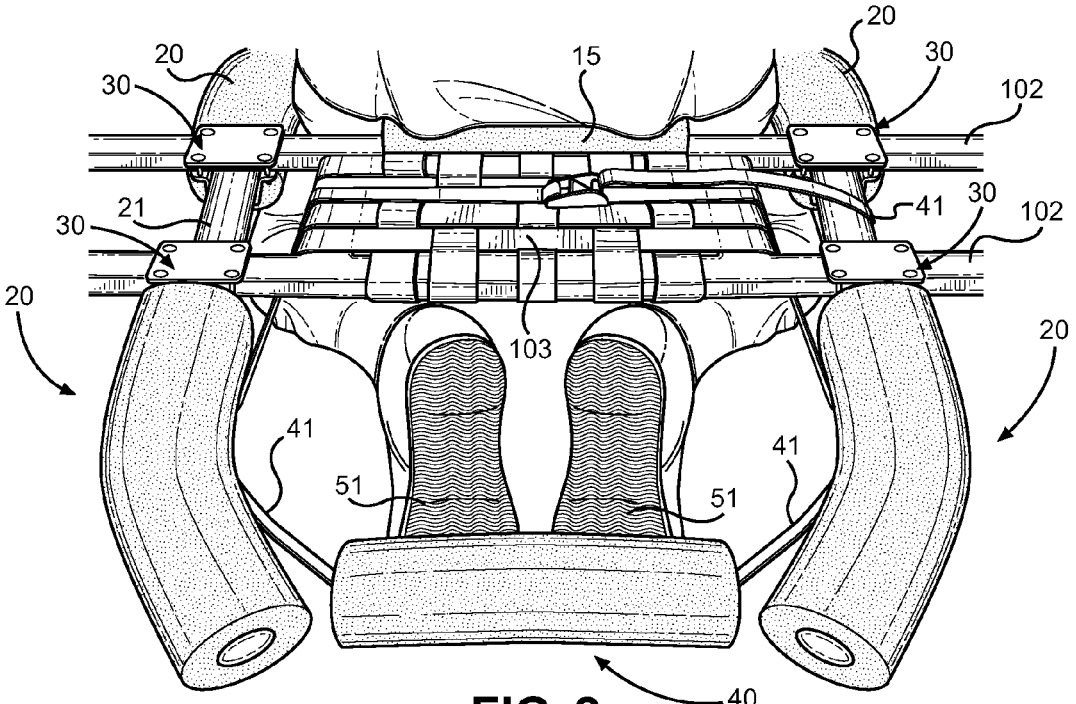
FIG. 2 shows a view of a canoe user from behind when seated in the assembly of the present invention.
Figure 4:
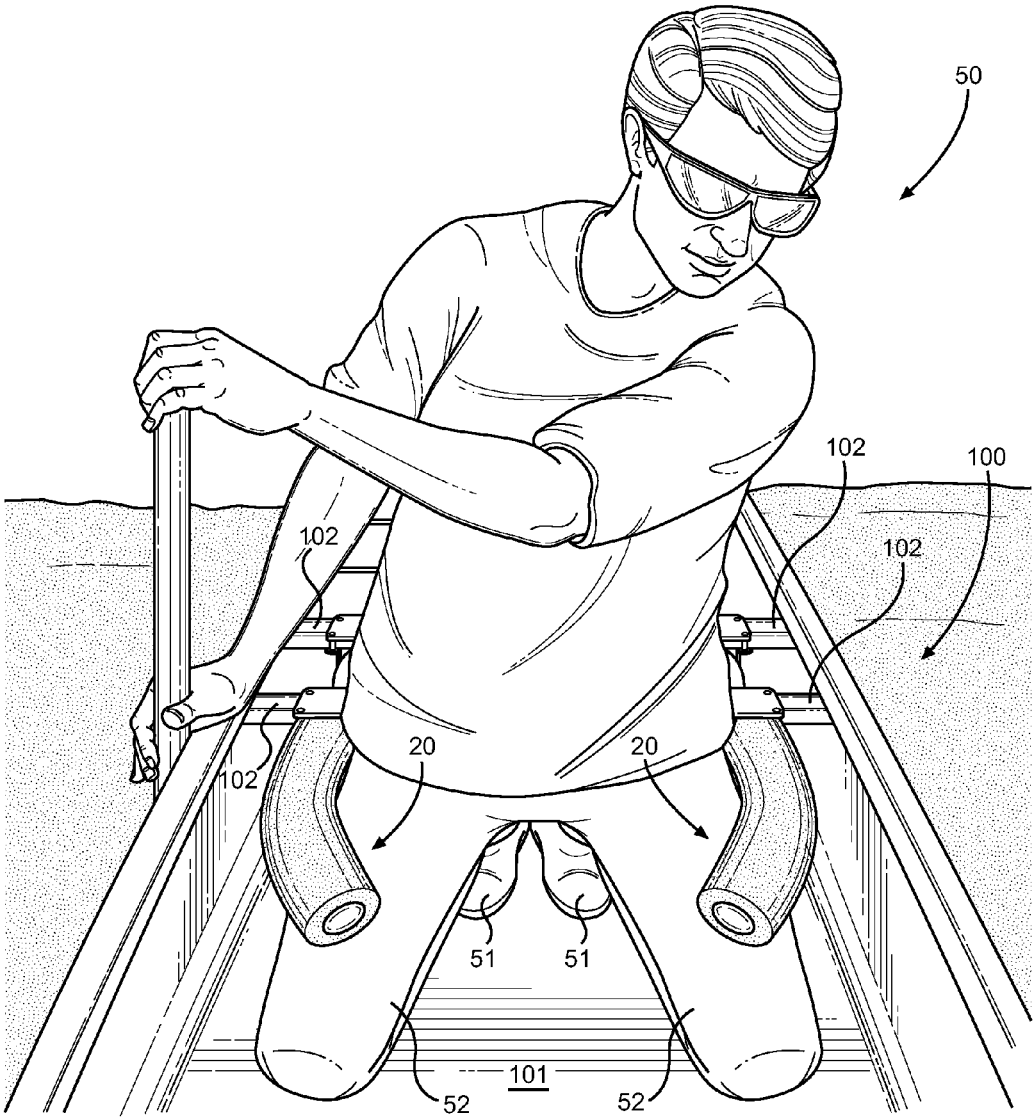
FIG. 4 shows a frontal view of a canoe user seated within the assembly of the present invention.

Referring now to FIGS. 1, 2 and 4, there are shown several views in which the paddle force transfer assembly of the present invention is deployed in a working state, wherein a user 50 is in a kneeling position along the hull bottom 101 of a canoe 100. During use, thigh braces 20 are deployed from the forward edge of a canoe seat while a foot brace 40 is provided across hull bottom 101 of the canoe aft of the same canoe seat. The thigh braces 20 bear against the user's thighs 52, while the user's feet 51 are pressed against the foot brace 40. A seat-edge covering 15 is also provided along the forward canoe seat rail 102 behind the user. This assembly allows the user to press his feet 51 against the foot brace, his thighs against the thigh braces 20, and also comfortably press against the canoe seat while paddling the canoe 100.

The thigh braces 20 are comprised of elongated members secured to the canoe seat rails 102 by clamp assemblies 30, which support the braces 20 in a fixed or rotatable condition.

The foot brace 40 is a tubular member that is supported by an elongated strap 41 that extends therethrough and over the canoe seat 103 upper surface. The strap 41 is adjustable such that the fore-aft position of the foot brace can be tailored to the user's preferences.

Figure 3:
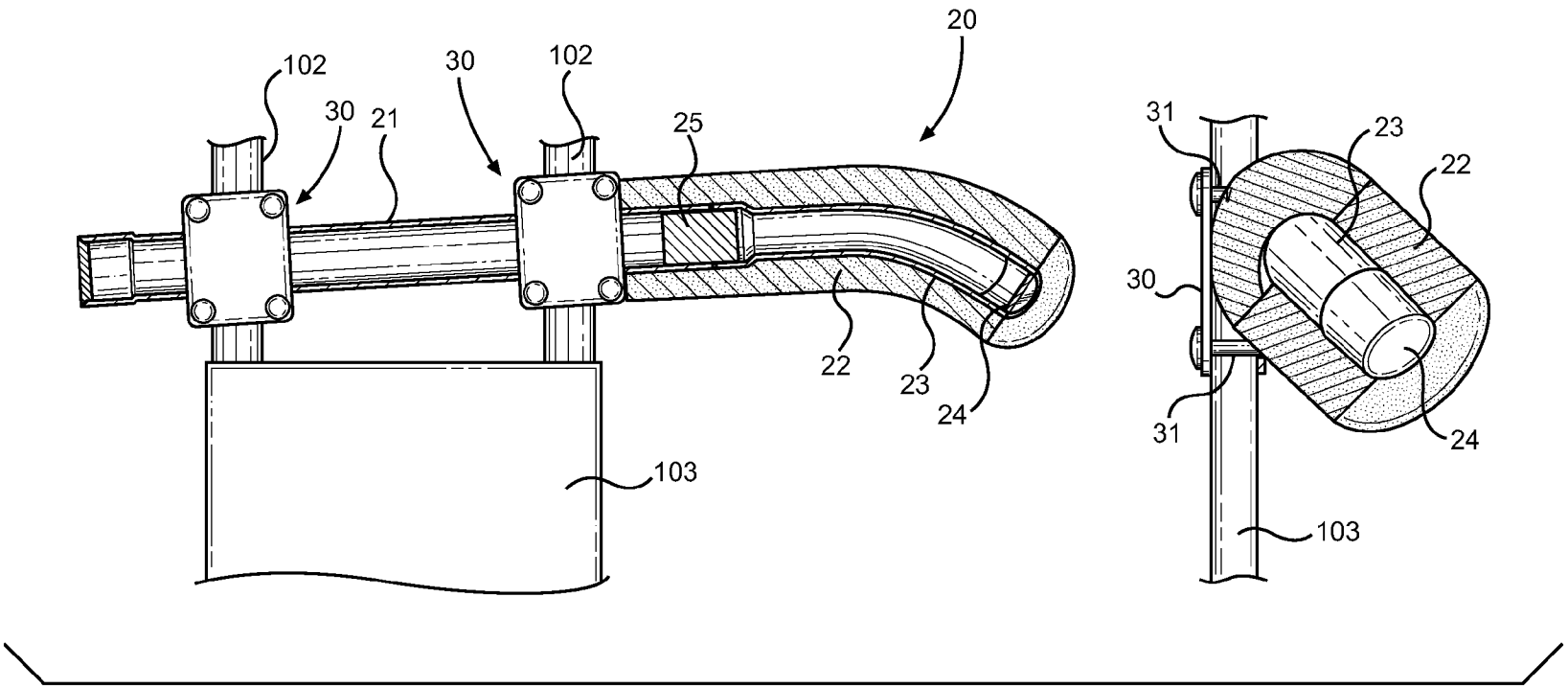
FIG. 3 shows a top view and front view of the thigh braces of the present invention.
Figure 5:
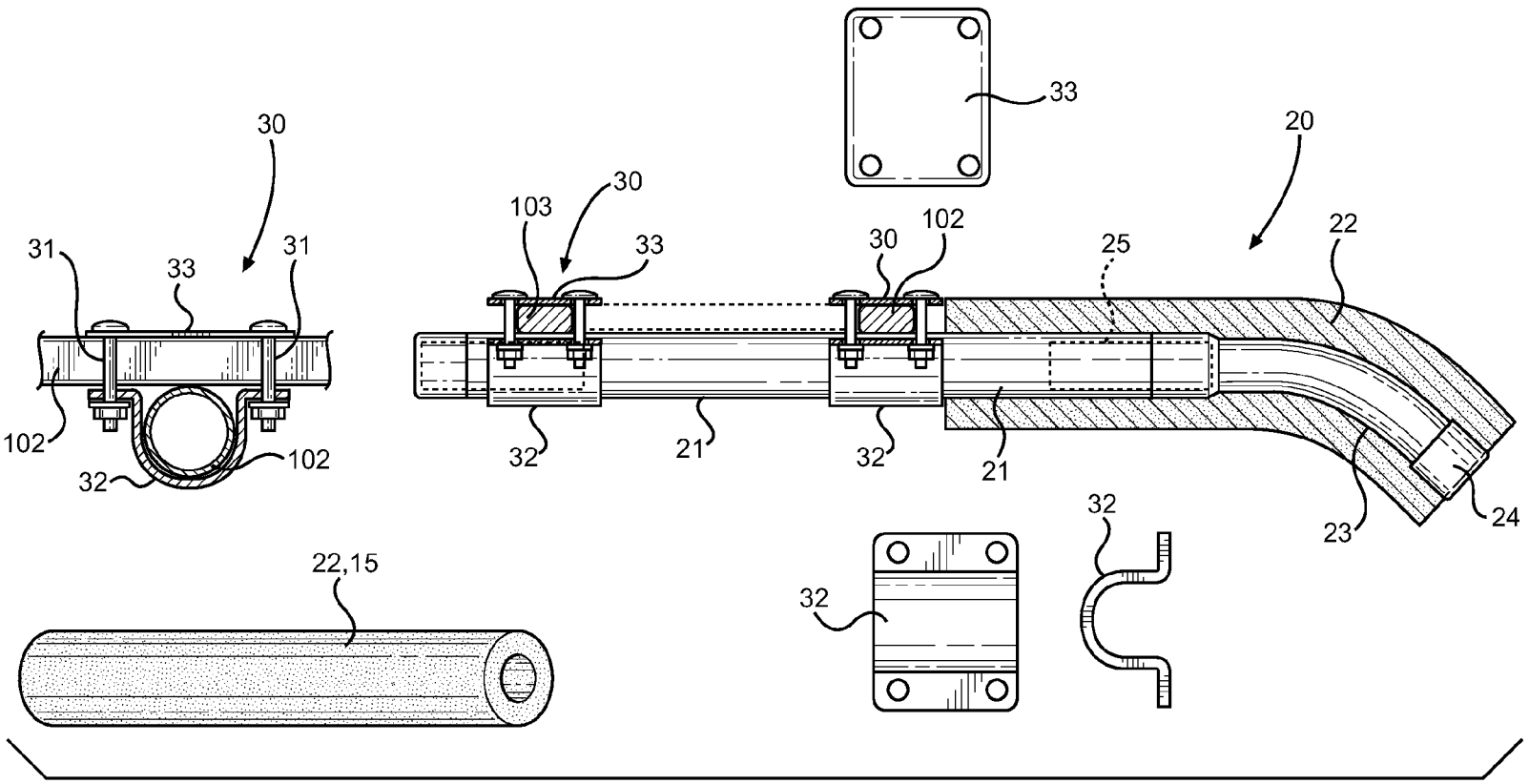
FIG. 5 shows another view of the thigh braces of the present invention and its mounting components for a single seat installation.

Referring now to FIGS. 3 and 5, there are shown the elements of the thigh supports of the present invention in a single-seat embodiment. FIG. 3 represents an overhead cross section view and a frontal cross section view, while FIG. 5 shows the individual elements of the single-seat thigh brace and a sectional side view of the installed assembly. The thigh braces 20 of the present invention are elongated members having a unitary or composite construction (as shown). In its composite construction, several members are mated together to form the length and shape of the brace structure. It is contemplated that this construction may be provided as singular structure or preferably as an assembly of constituent members, as shown in FIG. 3. The preferred brace member construction comprises a support tube 21 adapted to span the gap between the rails 102 of the canoe seat 103 and be secured thereto by way of a first and second clamp assembly 30. The support tube 21 is an elongated member that is secured to an arcuate brace member 23 by way of adhesive and a joint stub 25 therebetween. The support tube 21 construction may be one of a hollow member or solid member. The distal end of the arcuate brace member 23 is enclosed by an end cap 24, while the exterior surface thereof is enveloped by a foam pad 22 exterior.

The clamp assemblies 30 support the thigh brace at each canoe rail 102, whereby fasteners 31 secure the thigh brace 20 between a rounded clamp 32 and a top plate 33. A pair of clamp assemblies 30 is utilized to secure the assembly 20 in a static position relative to the canoe seat, whereby the thigh brace 20 may be affixed thereto. The foam covering 22 of the thigh braces is used as a cushioning member between the arcuate brace member 23 and the user's thighs, while the same covering material is utilized against the existing canoe seat edge such that the material offers a canoe seat-edge covering 15.

Figure 6:
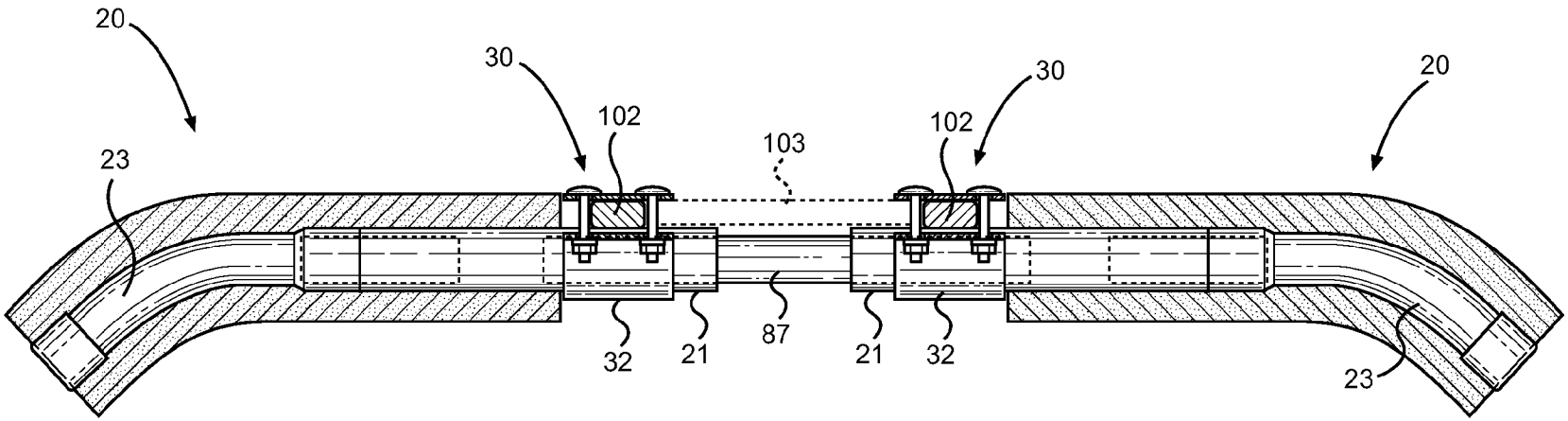
FIG. 6 shows a view of the thigh braces for one side of a dual canoe seat configuration.

Referring now to FIG. 6, there is shown a view of the dual-seat embodiment of the present invention, wherein a pair of thigh braces 20 is supported from a canoe seat 103 in an opposing relationship. A pair of support tubes 21 are concentrically supported by an extension tube member 87 positioned below the seat 103. The extension tube member 87 allows the two support tubes 21, and thus the two thigh braces 20, to be positioned at different angles with respect to one another when deployed. As with the single seat embodiment, the dual-seat embodiment contemplates either a unitary or composite construction, the composite construction comprising the arcuate brace member 23 connecting to the support tubes 21. The elongated members of the composite construction are individually supported by a clamp assembly 30, securing each to the rail 102 of the canoe seat 103. Similarly, the extension tube member 87 may comprise a hollow or solid member.

Figure 7:
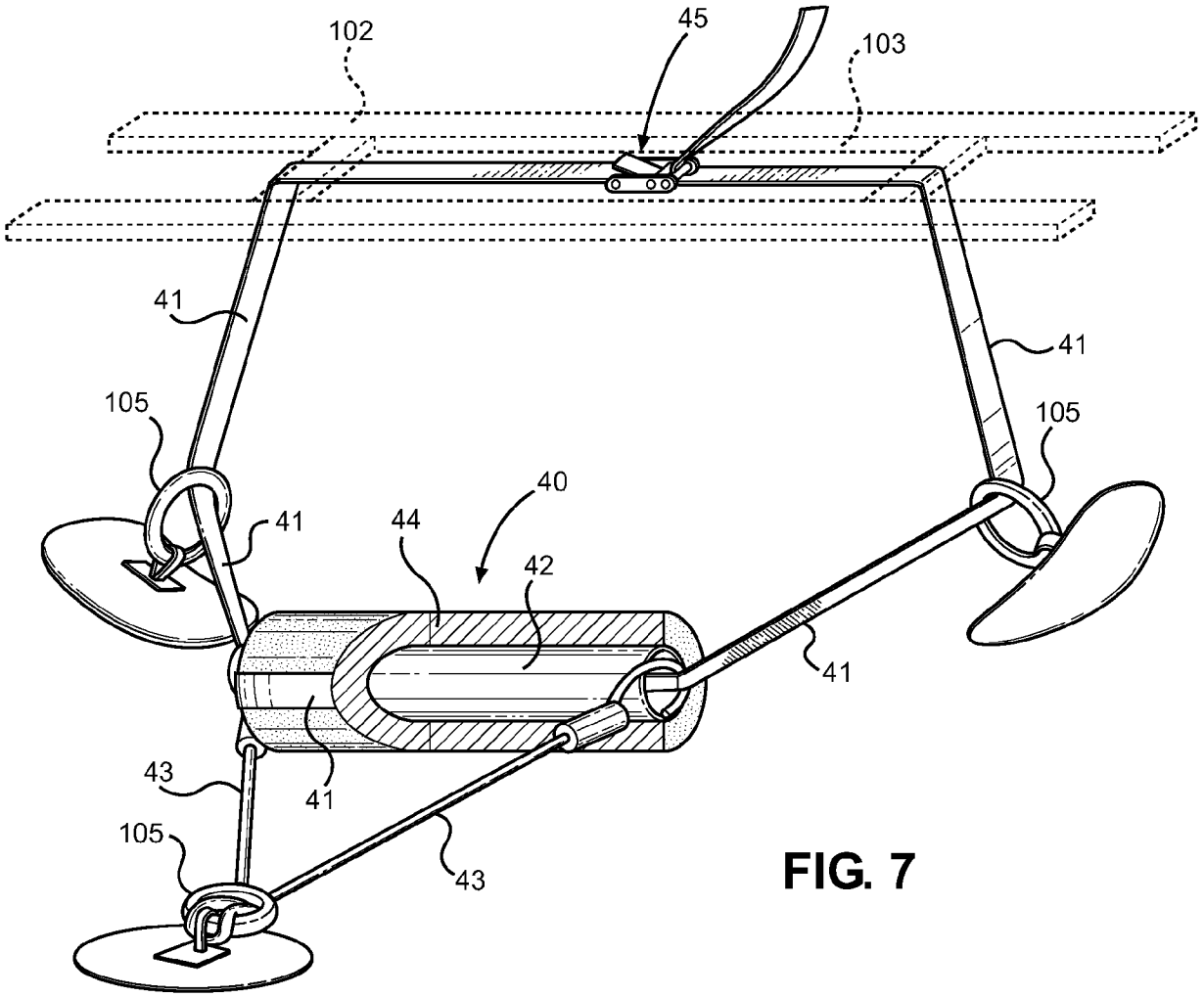
FIG. 7 shows a view of the foot brace and its attachment to the canoe seat.
Figure 8:
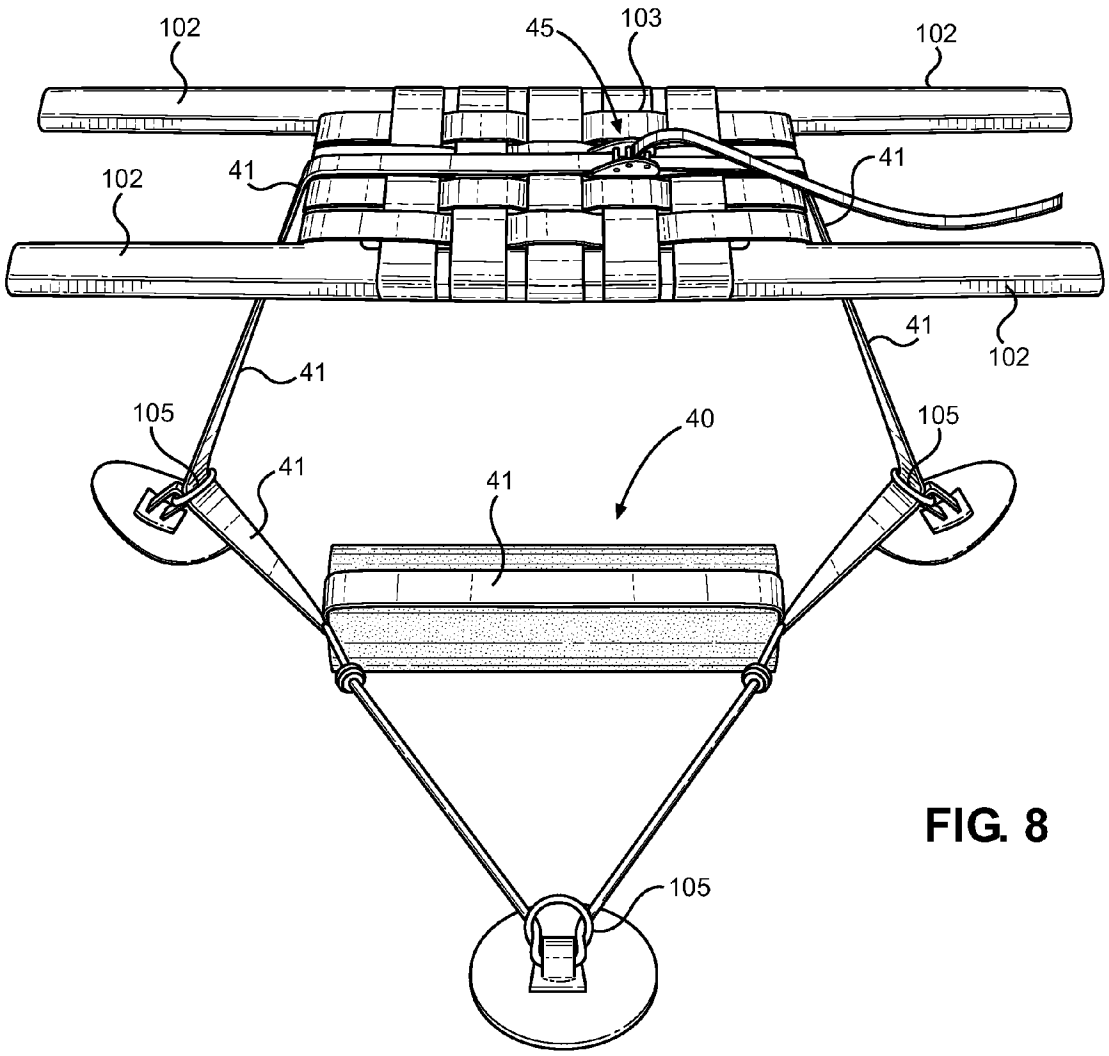
FIG. 8 illustrates the installation of the foot brace on the canoe seat and to the installed anchors.
Figure 9:
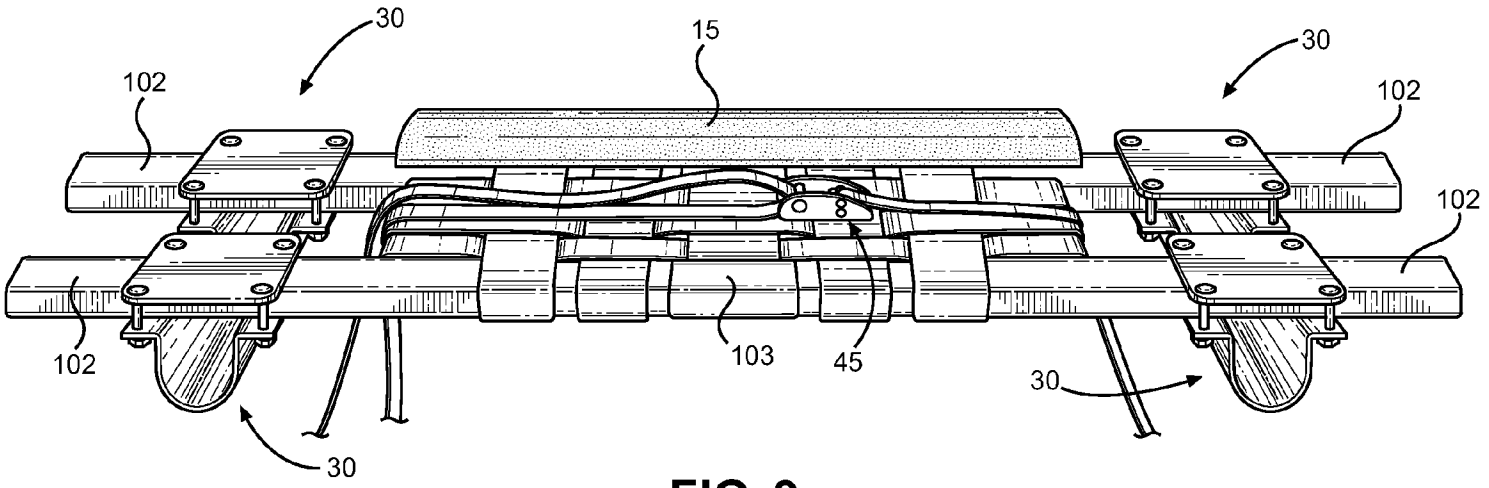
FIG. 9 shows the thigh brace clamp assemblies mounted to the canoe seat.

Referring now to FIGS. 7 through 9, the foot brace 40 of the present invention and its connection to the canoe seat 103 is shown. The foot brace 40 comprises an elongated tubular member 42 that includes a pad cover 44 thereover. Its position within the canoe interior is controlled by a foot brace strap 41 that extends through the foot brace interior, through a pair of opposing ring anchors 105 and over the upper surface of the canoe seat 103 between the canoe seat rails 102. The rings 105 are affixed to the interior hull surface of the canoe and provide anchor points through which the strap 41 extends. Tension is placed on the foot brace 40 by an elastic cord 43 affixed to a rearward ring anchor 105, wherein the cord 43 draws the brace 40 rearward with respect to the seat 103 such that the user can readily locate the foot brace 40 when entering the canoe or while paddling therein. The exact position of the brace 40 is controlled by adjusting the length of strap 41 extending rearward from the opposing rings 105, wherein a strap adjustor 45 is provided for extending or shortening the length thereof.

Figure 10:
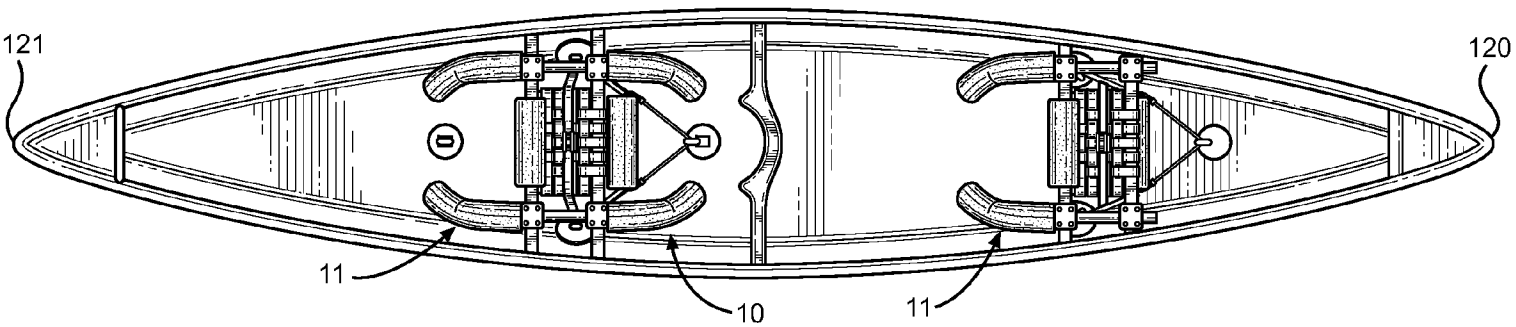
FIG. 10 shows an overhead view of the present invention installed on a canoe, wherein a single-seat and dual-seat embodiment are deployed.
Figure 11:
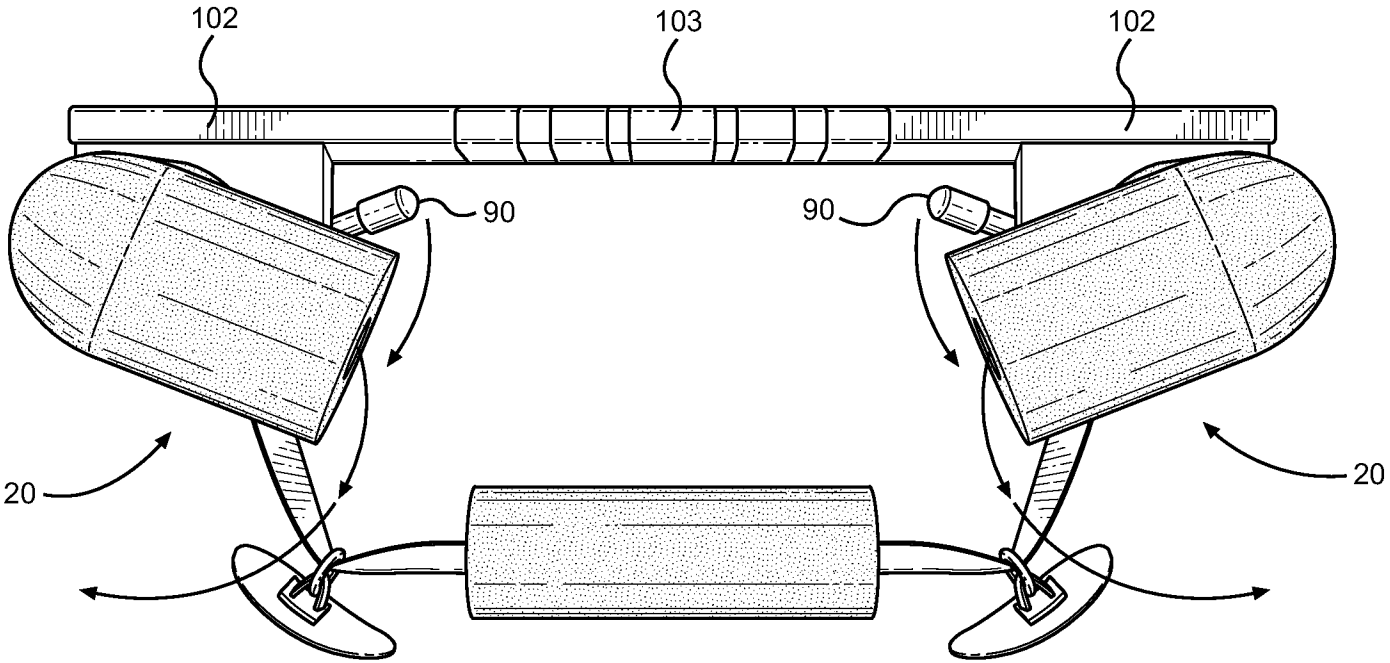
FIG. 11 shows a view of the sweep angle of the thigh braces in the biased embodiment of the present invention.
Figure 13:
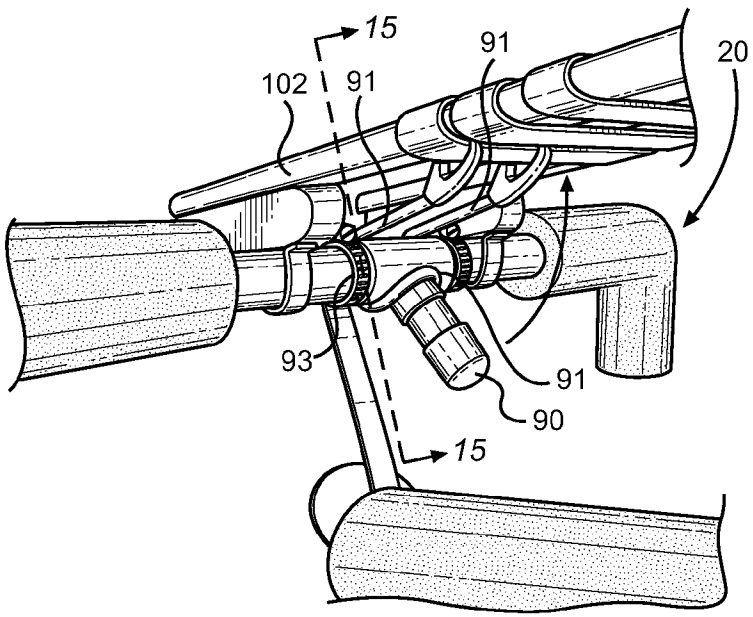
FIG. 13 shows a view of the biased embodiment and its elastic retractor cord in an open state.
Figure 12:
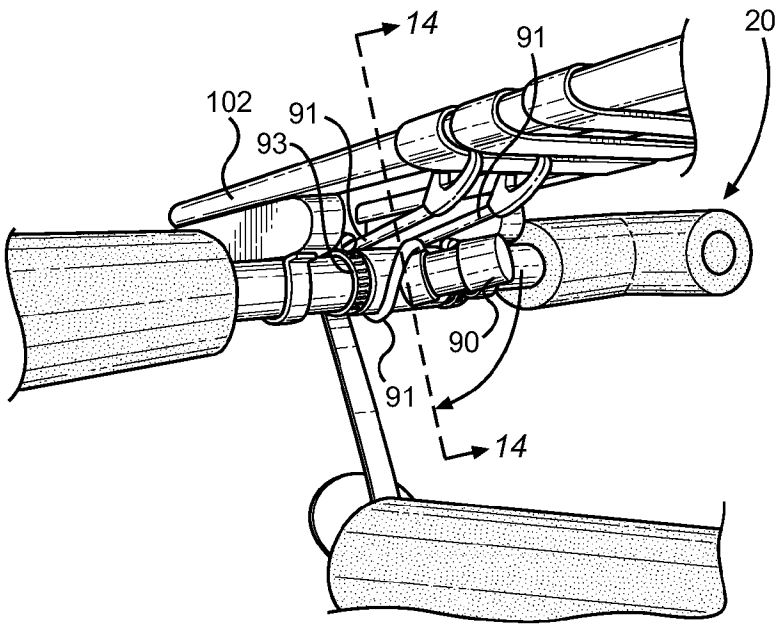
FIG. 12 shows a view of the biased embodiment and its elastic retractor cord in a deployed state.
Figure 15:
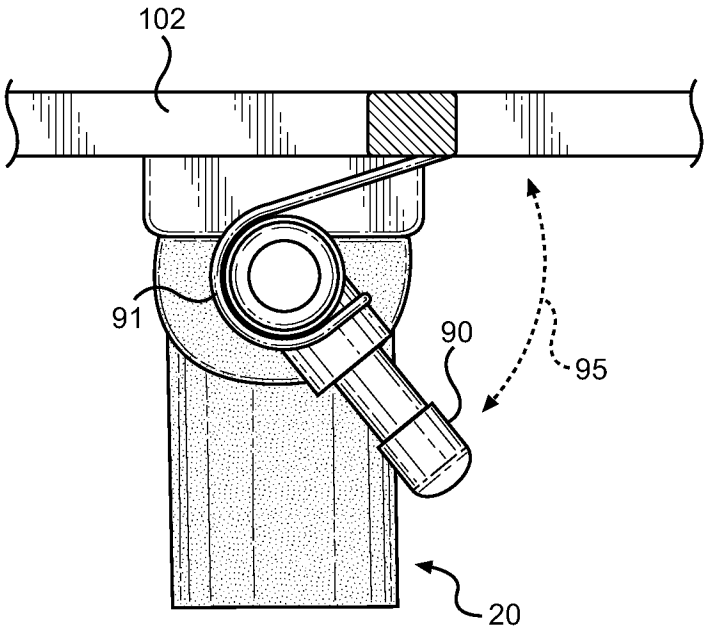
FIG. 15 shows another view of the biased embodiment and its elastic retractor cord in an open state.
Figure 14:
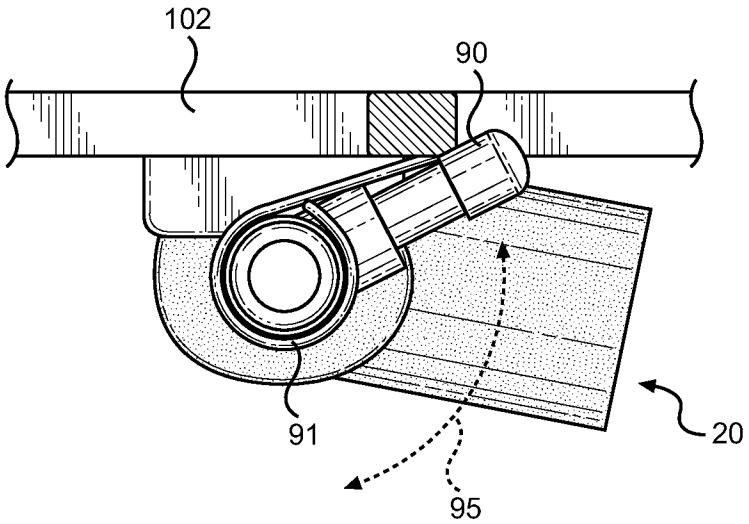
FIG. 14 shows another view of the biased embodiment and its elastic retractor cord in a deployed state.
Figure 16:
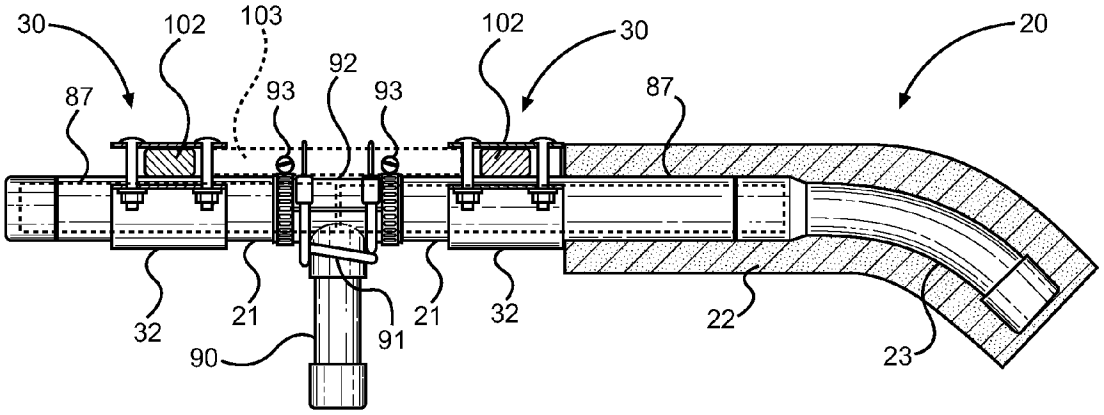
FIG. 16 shows a side view of the biased embodiment for the single-seat configuration.
Figure 17:
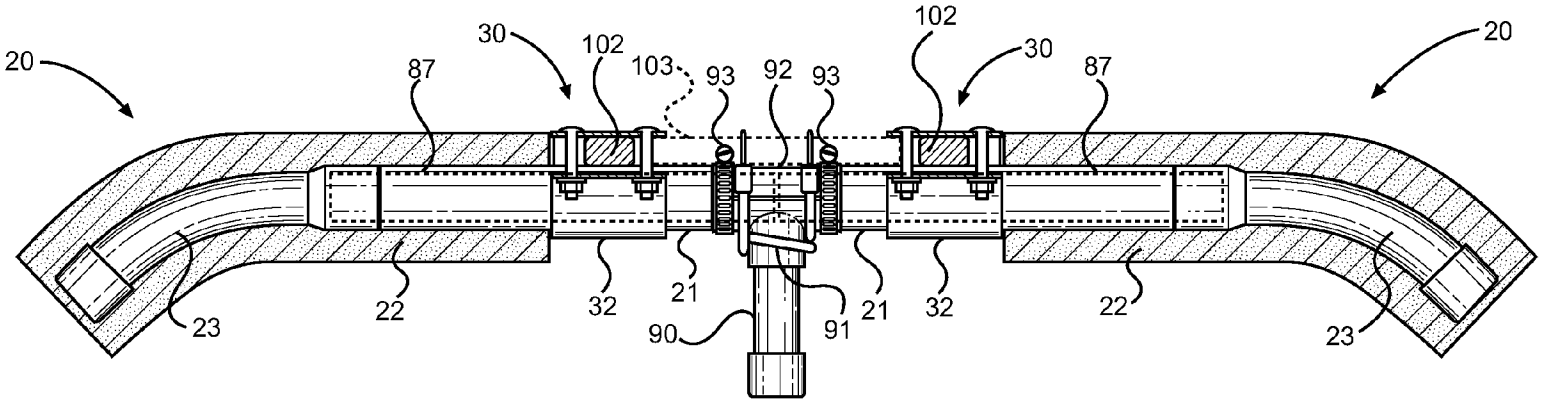
FIG. 17 shows a side view of the biased embodiment for the dual-seat configuration.

Referring now to FIG. 10, there is shown an overhead view of the paddle force transfer assembly of the present invention deployed in a tandem configuration and a single configuration. The dual seat configuration is attached to one of the canoe seats, while the single is attached to the other. While canoeing solo (by oneself), the solo paddle force transfer braces 10 are used and the first end 120 of the canoe is used as the bow. In solo setup, the solo-seat foot brace is reversed from that shown in FIG. 10. While canoeing in tandem (with two canoeing users), both the tandem paddle force transfer braces 11 are utilized and the second end 121 of the canoe is used as the bow. In this way, the dual and single assemblies can be deployed simultaneously on the same canoe, providing the user with options for both solo and tandem use thereof.

Referring now to FIGS. 11 through 17, there is shown the biased embodiment of the present invention that incorporates rotating thigh braces 20. The interconnected rotating members of the assembly include the foam covers 22, the arcuate ends 23 attached to the extension tubes 87, the protrusion members 90 that are adapted to receive an elastic cord 91 therearound, and a spilt T-member 92 clamped tightly onto the ends of the two extension tubes 87 by member clamps 93. The extension tubes 87 are rotatably supported within the elongated support tubes 21, which in turn are supported by the clamp assemblies 30. The T-member 92 is clamped to the end (or opposing ends) of the extension tubes 87. An elastic cord 91 is connected to the seat frame and is stretched and wrapped around protrusion member 90 in a manner that rotationally biases each thigh-brace assembly (both single and dual seat) into the retracted position, i.e. a vertical, downward-facing position. The thigh braces 20 are capable of rotation along a sweep path 95, wherein the extension tubes 87 thereof are supported by and freely rotate within the support tubes 21 which are held immovable by the brackets 30 attached to the canoe seat rails 102. The paddler kneels between the retracted brace assemblies, and manually rotates both inward and upward to the deployed position (set and limited during first fitting by the protrusion members contacting the seat frame), then presses his thighs against the thigh braces, holding them in the deployed condition and himself fully braced. When the paddler removes his thigh pressure from the thigh braces, the thigh brace assemblies automatically rotate back to the retracted position, facilitating unobstructed space for exits and entries by the paddler.

Staying in proper paddler position, especially in rough water and forceful paddle maneuvers, depends entirely upon the paddler maintaining sufficient thigh pressure against the thigh braces of the present invention. This thigh pressure, enhanced by foot pressure against the firmly-set foot brace and the curve of the thigh braces around the paddler's thighs all work together to keep the paddler wedged against the canoe seat for high-force paddle maneuvers and to remain in position under sudden jolts encountered in upper-class white water. Conversely, when circumstances dictate a need to exit the canoe for a quick "bail out", then simply relaxing the thighs and feet and bringing the knees together effects immediate release of the present invention, allowing for an unrestricted exit from the seat and the canoe.

The best fit with present invention is one that maximizes long-term paddling comfort and "locked-in" control of the canoe in all maneuvers. Following are some guidelines for achieving a best fit condition. Remember, the best fit for you is the fit that works best for you, personally. Four Fit Parameters are contemplated:

1) Assembly Spacing (AS) is the lateral distance from boat centerline to the thigh brace centerline, measured along each seat-support centerline (front and rear). Best AS will place the paddler's knees as wide apart as is comfortable, providing maximum leverage on the canoe, but not so wide that a) the "stretch" will cause discomfort with extended time in the position, or b) paddler's buttocks are too low (Foam Covers on seat edges are recommended). Knees should rest on the hull bottom with a spread no wider than the mid points of the hull's upward curves.

2) Leg Spacing (LS) is the lateral spread of the paddler's thighs at the widest thigh brace contact point, measured from boat centerline to thigh brace centerline at that widest point. This is not strictly a fitting-set parameter, but is established by front & rear assembly spacing and assembly extensions. When front and rear assembly spacings are equal, the support tubes are parallel, and AS=LS.

3) Assembly Extension (AE) is the horizontal distance from position seat's front support centerline to tip of Thigh brace End Cap. Best AE provides the kneeling paddler with a) comfortable hip and knee flex without being uncomfortably erect, and with b) mid-buttocks resting on the seat edge (Foam Covers on seat edges are recommended).

4) Thigh brace Angle (SA) is the rotational angle of thigh brace from horizontal. Best SA provides maximum contact of the Foam-Covered braces with paddler's thighs, usually thirty to forty degrees downward. Brace Angles on either side of a position should be the same (for equal-length legs). Always perform the Fitting of all four variables in a "pressure-applied" mode, i.e. Foot Brace snugly against the balls of the feet, both feet firmly pressing against the Foot Brace, and with thighs pressing outward and firmly against the Thigh braces. With best fit and firm pressure applied, paddler will be "locked in" to perform high-force paddle maneuvers for all classes of white water. In tandem outfitted canoes, one position of the dual-position seat often requires fit parameters that differ from the other position (for different paddler sizes). This can be accommodated by the present design, in both the preferred or biased embodiments.

Changes can be made to any or all of the Fit Parameters of any position. Effective recording and Reference Marking of each position's parameters will facilitate resetting any position to previous spec at any time. It can be thought of as adjusting a car's driver's seat position and seatbelt for a different driver.

Ideally the user of the present invention will deploy knee pads, which are standard white-water canoe gear. There are basically two types: paddler-worn pads, or boat-mounted pads. Boat-mounted pads are fixed, consume hull space, and cannot be adjusted for paddler size or preferences; they are required in every paddler position. Paddler-worn pads are only there when needed and always in the correct location for the paddler. Paddler-worn pads are strongly recommended. The installer/paddler may add boat-mounted pads, later, if he so chooses.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A canoe paddle force transfer assembly adapted to be installed onto an existing canoe seat, comprising:

a first pair of thigh braces and a foot brace;

said thigh brace comprising an elongated support tube, an arcuate brace member end, and a pad covering thereover;

a first and second clamp assembly for each thigh brace, each clamp assembly adapted to secure said elongated support tube to a canoe seat rail;

said foot brace comprising an elongated tubular member and a foot brace strap, said foot brace strap being secured through a first and second ring anchor attached to the canoe inner surface, said strap securing over said canoe seat.

2. A method of installing a canoe paddle force transfer assembly onto an existing canoe seat, comprising the steps of:

installing a pair of ring anchors and a rearward ring anchor onto a canoe interior surface;

supporting a foot brace along a canoe hull interior surface using a foot brace strap supported from said rearward ring anchor, through said pair of ring anchors, and over an existing canoe seat;

installing thigh braces onto a canoe seat.

3. The canoe paddle force transfer assembly of claim 1, further comprising:

a second pair of thigh braces concentrically aligned with said first pair of thigh braces;

said first pair of thigh braces and second pair of thigh braces concentrically aligned and having an extension tube member therebetween;

said first pair of thigh braces adapted to be extended from a first edge of said canoe seat;

said second pair of thigh braces adapted to be extended from a second edge of said canoe seat.

4. The canoe paddle force transfer assembly of claim 1, further comprising:

said thigh brace being rotatably connected to said first and second clamp assembly;

a protrusion member extending from said elongated support tube;

an elastic cord positioned around said protrusion member and securing to said canoe seat;

said elastic cord biasing said protrusion member such that said arcuate brace member end is biased to rotate downward.

5. The canoe paddle force transfer assembly of claim 1, wherein:

said foot brace further comprises a pad covering thereover.

6. The canoe paddle force transfer assembly of claim 1, wherein:

said foot brace further comprises an elastic cord connected thereto and secured to a rearward ring anchor attached to the canoe inner surface;

said elastic cord biasing said foot brace toward said rearward ring anchor.

7. The canoe paddle force transfer assembly of claim 1, wherein:

said foot brace strap further comprises a strap length adjuster.

8. The canoe paddle force transfer assembly of claim 1, further comprising:

a seat-edge covering adapted to secure to an edge of said canoe seat.

9. The canoe paddle force transfer assembly of claim 1, wherein:

said elongated support tube and said arcuate brace member end comprise a unitary member.

10. The canoe paddle force transfer assembly of claim 1, wherein:

said elongated support tube and said arcuate brace member end comprise a separable member secured together via a joint stub and adhesive.

11. The canoe paddle force transfer assembly of claim 1, wherein:

each clamp assembly further comprises a top plate, a rounded clamp adapted to surround said elongated support tube, and a plurality of fasteners clamping said top plate and rounded clamp together;

said top plate and said rounded clamp adapted to sandwich a canoe seat rail.

12. The canoe paddle force transfer assembly of claim 1, further comprising:

said thigh braces each having a concentrically aligned extension tube member rotatably supported within said elongated support tube and extending therefrom below said canoe seat;

a split T-member secured to said extension tube member;

said split T-member having a protrusion member extending therefrom;

an elastic cord positioned around said protrusion member and securing to said canoe seat;

said elastic cord biasing said protrusion member such that said arcuate brace member end is biased to rotate downward.

13. The canoe paddle force transfer assembly of claim 1, further comprising:

a second pair of thigh braces concentrically aligned with said first pair of thigh braces;

said first pair of thigh braces and second pair of thigh braces concentrically aligned and having at least one extension tube member therebetween;

said first pair of thigh braces adapted to be extended from a first edge of said canoe seat;

said second pair of thigh braces adapted to be extended from a second edge of said canoe seat;

said extension tube member of said first and second pair of thigh braces rotatably supported within a first and second elongated support tube, said extension tube member of said first and second pair of thigh braces extending from said first and second elongated support tube and below said canoe seat;

a split T-member secured to said extension tube members;

said split T-member having a protrusion member extending therefrom;

an elastic cord positioned around said protrusion member and securing to said canoe seat;

said elastic cord biasing said protrusion member such that said arcuate brace member end is biased to rotate downward.

* * * * *